US005400445A

United States Patent [19]

Hull

[11] Patent Number: 5,400,445

[45] Date of Patent: Mar. 28, 1995

[54] TOILET TANK TRIP LEVER ASSEMBLY

[75] Inventor: Douglas A. Hull, Sheboygan, Wis.

[73] Assignee: Kohler Co., Kohler, Wis.

[21] Appl. No.: 88,994

[22] Filed: Jul. 8, 1993

[51] Int. Cl.[6] ..... E03D 3/12; E03D 5/09

[52] U.S. Cl. ..... 4/325; 4/405; 4/415

[58] Field of Search ..... 4/324, 325, 405, 415, 4/326, 327

[56] References Cited

U.S. PATENT DOCUMENTS

| | | | |
|---|---|---|---|
| 2,626,401 | 1/1953 | Blair | 4/415 |
| 2,627,607 | 2/1953 | Crampton | 4/405 |
| 3,795,016 | 3/1974 | Eastman | 4/326 |
| 3,988,786 | 11/1976 | Lehfeldt | 4/67 A |
| 4,056,856 | 11/1977 | Reid et al. | 4/326 |
| 4,406,024 | 9/1983 | Chiu et al. | 4/324 |
| 4,411,029 | 10/1983 | Huang | 4/324 |
| 4,530,119 | 7/1985 | Chiu et al. | 4/324 |
| 4,624,018 | 11/1986 | Kurtz | 4/325 |
| 4,750,220 | 6/1988 | Baumann | 4/324 |
| 4,764,995 | 8/1988 | Harney | 4/325 |
| 4,837,867 | 6/1989 | Miller | 4/324 |
| 4,864,665 | 9/1989 | Toltzman | 4/325 |
| 4,881,279 | 11/1989 | Harney | 4/324 |
| 5,105,480 | 4/1992 | Howell et al. | 4/325 |

OTHER PUBLICATIONS

Undated p. 4–3 of Kohler catalog showing, *inter alia*, a single flush toilet tank trip lever assembly, admitted prior art.

*Primary Examiner*—Henry J. Recla
*Assistant Examiner*—Gregory M. Vidovich
*Attorney, Agent, or Firm*—Quarles & Brady

[57] ABSTRACT

There is disclosed a mechanism for initiating and controlling a toilet: flush mechanism of the type which permits selection between two flush cycles which use different volumes of water end which, to do that, requires that the flush valve be lifted to either of two levels. Each of two rotating handles drives a shaft which rotates a flush lever arm. The shafts are concentric. One of flush lever arms has a longer crank portion than the other so that points on the lever portion move a greater vertical distance for a given angular rotation than move corresponding points on the flush lever arm with the shorter crank portion. A single blocking member limits the rotation of both flush lever arms to the same range of angular motion. Tabs on a bushing for the shafts supplement the blocking member by stopping rotation of the handle approximately when the blocking member contacts the flush lever arm driven by that handle.

3 Claims, 4 Drawing Sheets

FIG. 1
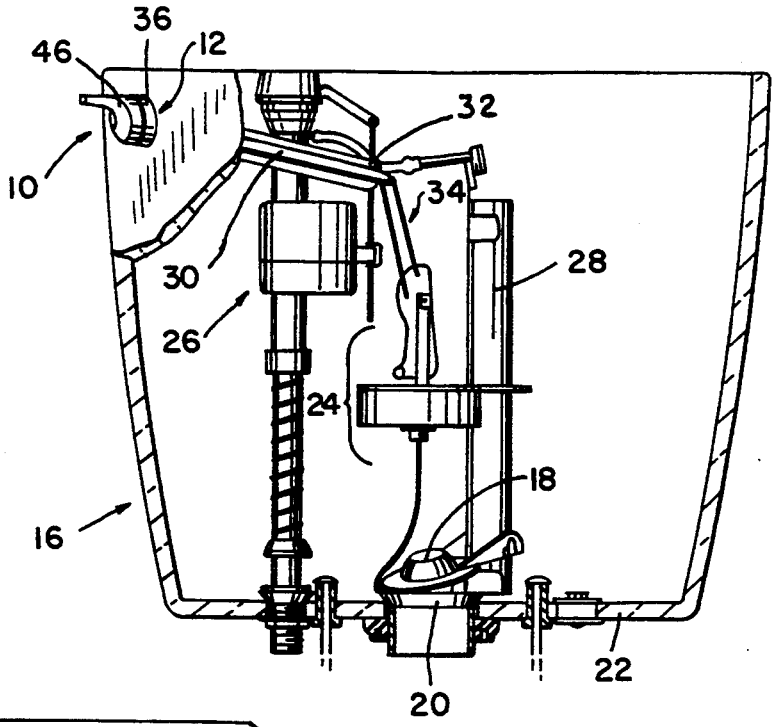
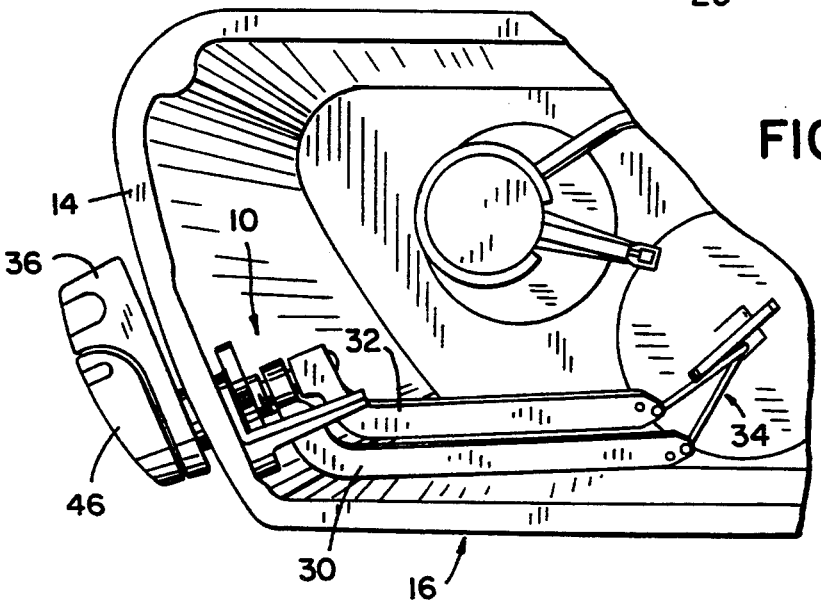
FIG. 2
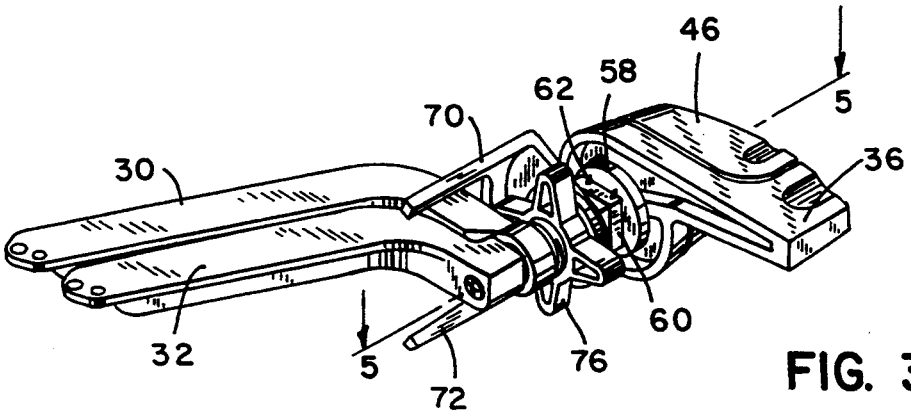
FIG. 3

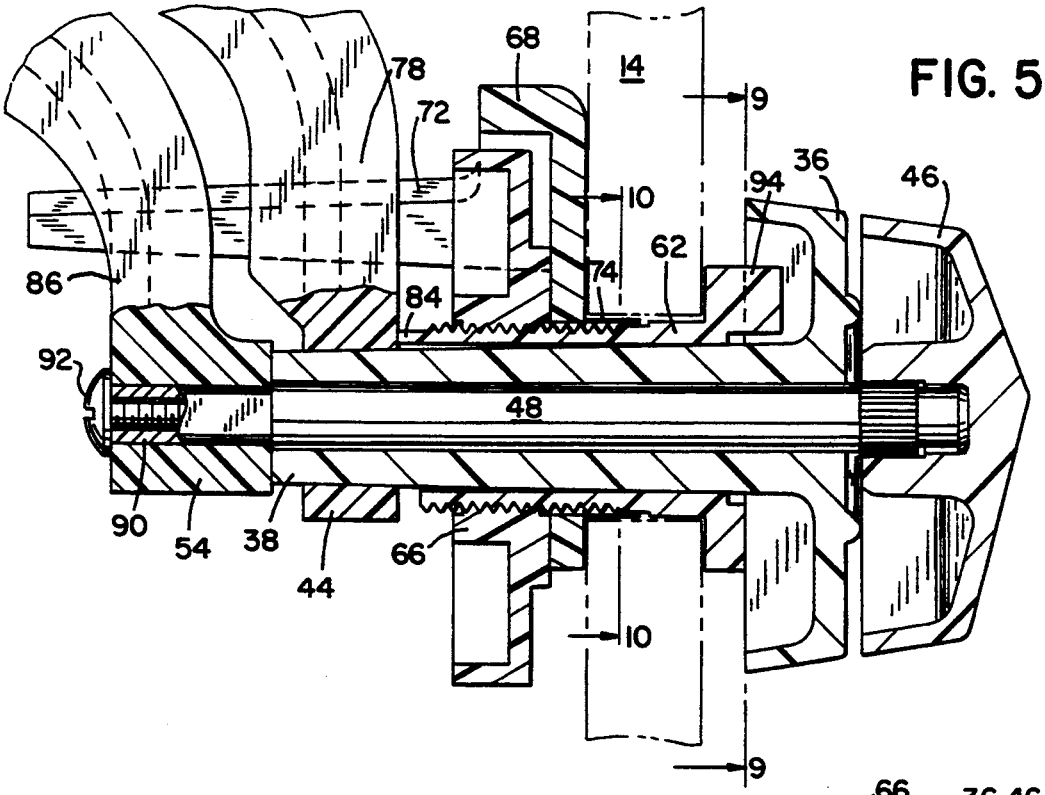
FIG. 5
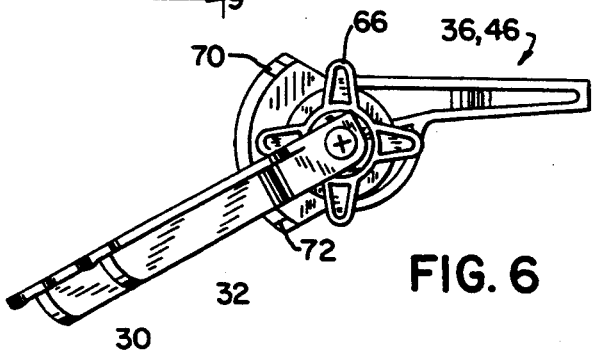
FIG. 6
FIG. 7
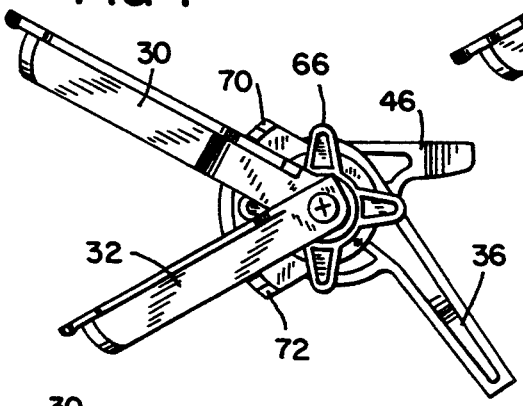
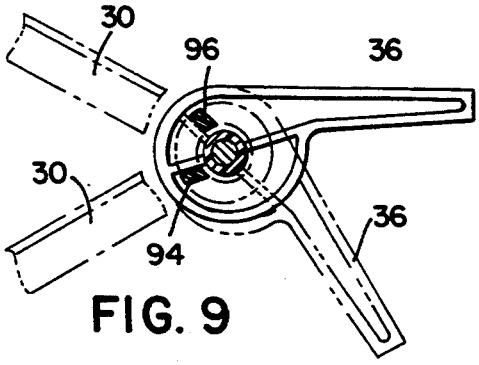
FIG. 9
FIG. 8
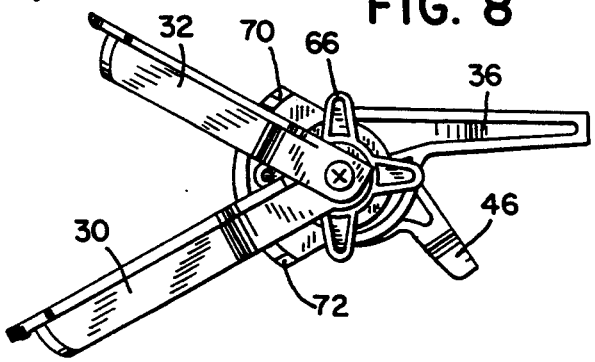

TOILET TANK TRIP LEVER ASSEMBLY

BACKGROUND OF THE INVENTION

1. Field of the Invention

The invention relates to toilet tank trip lever assemblies that allow the user to choose between selected flush volumes.

2. Description of the Art

Due to increasing population and limited water supply, conservation of water is becoming important. A significant source of water consumption is the water used in flushing toilets. The art has recognized that in some cases a full volume flush is not required to clean out a toilet bowl (e.g., urine and small amounts of paper only). Thus, many toilets that are designed to remove heavy amounts of feces and paper will waste water when faced with much lighter loads. The art has therefore developed toilet flushing mechanisms that use less water during certain flush cycles selected by the user.

In some of these dual flush mechanisms, the user selects one of two flush volumes by operating one of two flush handles on the toilet tank. To facilitate retrofitting existing toilets, and to minimize costs for new tanks, it is important that the control mechanism use only a single handle hole in the toilet tank. Accordingly, control mechanisms have been developed which employ two handles mounted to a single shaft or to concentric shafts which extend through the single handle mounting hole of a conventional toilet tank. Internally, the shafts are attached to one or more members which open the flush valve for a full flush or a partial flush respectively. See, for example, U.S. Pat. No. 4,837,867.

More widespread adoption of such systems has been deterred in part because of cost, complexity, difficulty in installation, concerns about reliability and/or other problems. For example, there has been difficulty in developing breakage resistant systems that use plastic components.

SUMMARY OF THE INVENTION

The invention provides a trip lever assembly for use in conjunction with a toilet tank. It is mountable through a hole in a wall of the tank and has two lever arms positionable in the tank.

There is a hollow first shaft which is extendable through, and is rotatably supportable in, the mounting hole. The first shaft has a first handle mounted to it for rotating the first shaft. A second shaft is disposed in the first shaft hollow to rotate within the first shaft. The second shaft supports a second handle that rotates the second shaft.

A first and a second flush lever arm, which are positionable within the tank, are connected to the first shaft and second shaft respectively. Rotation of the first handle rotates the first flush lever arm and rotation of the second handle rotates the second flush lever arm.

A blocking member extends transverse to the first and second flush lever .arms so that the blocking member imposes a common limit on the movement of both the first and second flush lever arms in at least one direction.

An object of the invention is to provide a dual-flush trip lever assembly which approximates as much as possible conventional single flush trip lever assemblies in external appearance and external mode of operation, while being reliable, easily assembled and installed, and inexpensive. In addition, an object of the invention is provide a dual-flush control mechanism which can be easily retrofitted into existing toilets.

These and other objects and advantages of the present invention will be apparent from the description which follows. In the description, the preferred embodiments of the invention will be described with reference to the accompanying drawings. These embodiments do not represent the full scope of the invention. Rather, the invention may be employed in other embodiments. Reference should, therefore, be made to the claims to interpret the full breadth of the invention.

BRIEF DESCRIPTION OF THE DRAWINGS

FIG. 1 illustrates a toilet tank, partially in section, in which has been installed a toilet tank trip lever assembly embodying the present invention;

FIG. 2 is a top view of the trip lever assembly installed in the toilet;

FIG. 3 is a perspective view of the trip lever assembly;

FIG. 5 is a cross-sectional view of the trip lever assembly taken along line 5—5 of FIG. 3;

FIG. 6 illustrates the trip lever assembly in the same position, as seen from within the toilet tank as if the tank wall were transparent;

FIG. 7 is similar to FIG. 6 except that the first handle has been fully rotated;

FIG. 8 is similar to FIG. 6 except that the second handle has been fully rotated;

FIG. 9 is a cross-sectional view taken on line 9—9 of FIG. 5 and illustrates the interaction of the first and second stop elements;

DESCRIPTION OF THE PREFERRED EMBODIMENTS

Figures 4, 10:
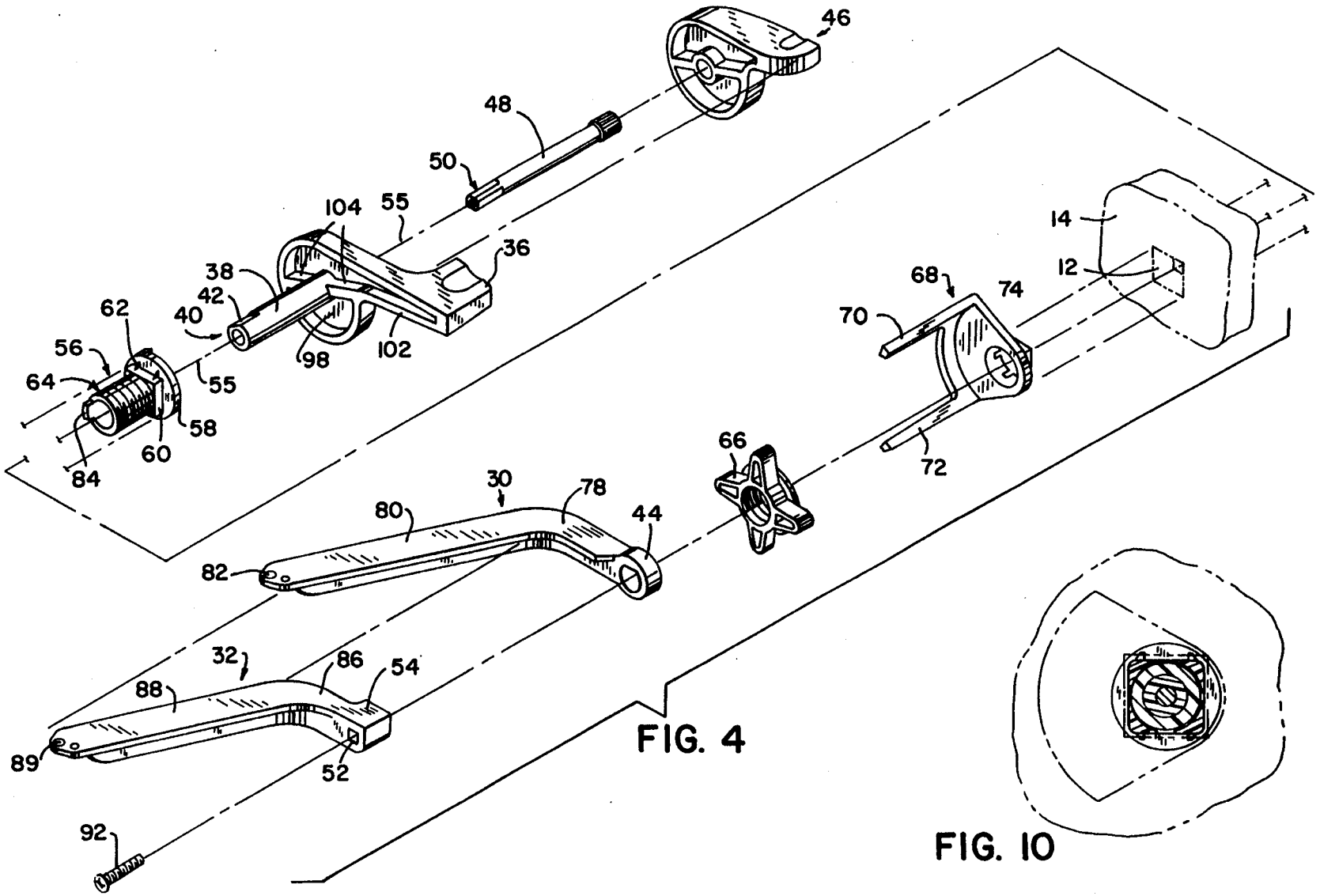
FIG. 4 is an exploded view showing the parts of one embodiment of the present invention, and how they fit together.
FIG. 10 is a cross-sectional view taken along line 10—10 of FIG. 5.

In FIGS. 1 and 2, an embodiment of the trip lever assembly 10 of the present invention has been installed through a mounting hole 12 in a wall 14 of the toilet tank 16. In addition to the trip lever assembly 10, the tank 16 contains a valve member 18 covering an outlet 20 in the bottom wall 22 of the tank 16, a dual flush mechanism 24 which raises the valve member 18 and allows it to reseat, a shut-off mechanism 26 and an overflow pipe 28. The first 30 and second 32 flush lever arms of the trip lever assembly 10 are tensilely linked to the valve member 18, via a dual flush mechanism 24, by chains or other similar linkages 34. Operation of the mechanism 24 is described in co-pending application U.S. Ser. No. 08/018,631, filed Feb. 17, 1993, whose disclosure is hereby incorporated by reference. In the alternative, mechanism 24 could be replaced with valving such as that shown in FIG. 2 of U.S. Pat. No. 4,837,867.

FIG. 4 illustrates the components of one embodiment of the present invention. FIGS. 2, 3 and 5 provide details of their interconnection.

An inner, levered, rotatable handle ("first handle") 36 is provided with a hollow shaft ("first shaft") 38 whose end 40 has a flattened surface 42 for mating with the correspondingly shaped hub 44 of the first flush lever arm 30. An outer, levered, rotatable handle ("second handle") 46 is provided with a shaft ("second shaft") 48 whose inner end 50 is rectangular for mating with the rectangular opening 52 of the hub 54 of the second flush lever arm 32.

The first shaft 38 is shown as being integral with the first handle 36, and the second shaft 48 is shown as a separate part affixed to the second handle 46, such as by friction fit, adhesive, sonic welding or other means. However, either or both shafts could be integral or separate. The second shaft 48 is inserted into and can rotate concentrically about a common axis 55 within the first shaft 38. The two handles 36, 46 are shaped to allow the second 46 to nest adjacent the first 36, thereby giving the adjoined handles an appearance substantially like a conventional single flush handle.

The first handle 36 is inserted through and can rotate within a bushing ("second bushing") 56 which is mounted in the square, conventional mounting hole 12 of a tank wall 14. The flange 58 of the second bushing 56 has a square, eared platform 60 which fits into the mounting hole 12 and is secured therein by the ears 62 of the platform 60. The exterior 64 of the inner portion of the second bushing 56 is threaded in order, as will be seen, to mate with a winged locking nut 66.

Inserted into the mounting hole 12 from the tank side is a bushing ("first bushing") 68 which supports two arms 70, 72 extending into the tank 16 and which serve as flush lever arm blocking members 70, 72. First bushing 68 has a square, eared platform 74 (similar to the platform 60 of the second bushing) which fits into the mounting hole 12 from the inside of tank 16. The winged locking nut 66 is screwed onto the second bushing 56 and tightened to secure the assembly in the mounting hole 12. At this point, the first shaft 38 is rotatably supported in the mounting hole 12 by the first 68 and second 56 bushings, and the second shaft 48 can rotate concentrically within the hollow of the first shaft 38. The first 38 and second 48 shafts rotate about a common axis 55.

As shown particularly in FIG. 4, the first flush lever arm 30 is boomerang shaped and has a hub 44 formed on a crank portion 78 from which obliquely extends an arm portion 80. Holes 82 ("first link point") for attaching the flush chain or similar tensile linkage 34 are located near the end of the arm portion 80. The hub 44 is friction fitted onto the flatted inner end 40 of the first shaft 38 and abuts a separation tab 84 on the second bushing 56.

The second flush lever arm 32 is similarly shaped but smaller, having a shorter crank portion 86 and shorter arm portion 88. It too has holes 89 ("second link point") near the inner end of its arm portion 88 for attaching a flush chain or other tensile linkage 34. Its hub 54 has a rectangular passageway 52 which fits over the rectangular end 50 of the second shaft 48, which extends about midway into the hub 54 and there encounters a hollow, internally threaded liner 90 (FIG. 5) which is friction fitted into the outer portion of the hub 54. A bolt 92 screwed into the liner 90 holds the second flush lever arm 32 firmly on the second shaft 40.

As particularly seen in FIG. 3, the upper 70 and lower 72 blocking members extend across both the top and bottom respectively of both flush lever arms 30, 32. As seen in FIG. 6, both flush lever arms 30, 32 rest upon the lower blocking member 72 when controller 10 is in an at-rest status. As illustrated in FIG. 7, when the first handle 36 is rotated clockwise (viewed from within the tank 16), the first lever arm 30 rotates in the same direction until it is blocked by the upper blocking member 70. Similarly, as seen in FIG. 8, the second handle 46 may be rotated clockwise until the second flush lever arm 32 encounters the upper blocking member 70. It will be recognized that the two blocking members 70, 72 limit the first 30 and second 32 flush lever arms to the same range of angular motion.

Figure 11:
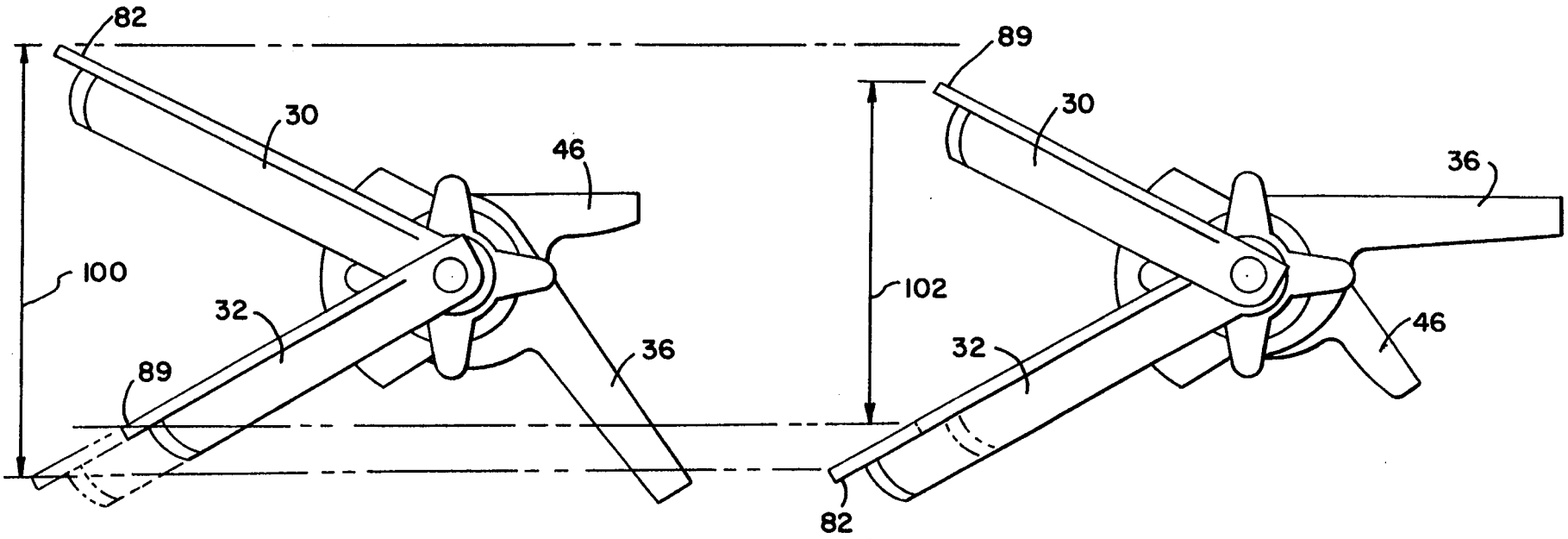
FIG. 11 is a schematic comparison of the length of vertical travel of the chain linkage points of the flush lever arms for a given angular rotation of the handles.

Because the crank and arm portions 78, 80 of the first flush lever arm 30 are longer than the crank and arm portions 86, 88 of the second 32, the flush chain mounting holes 82 of the first flush lever arm 30 are farther from the common axis 55 than are the holes 89 of the second flush lever arm 32. Thus, the holes 82 move a greater vertical distance for any given amount of angular rotation than move the holes 89. This can be seen in FIG. 11 which schematically compares the length 100 of the vertical motion of the chain mounting holes 82 of the first flush lever arm 30 with the length 102 of the vertical motion of the chain mounting holes 89 of second flush lever arm 32 when the first 36 and second 46 handles are rotated through their full, common range of angular motion. This accomplishes a key function needed to operate various types of dual flush mechanisms.

FIG. 9 illustrates another aspect of the invention—a stop element system for supplementing the action of the blocking members 70, 72 in setting the rotational range of the first handle 36 and first flush lever arm 30. The system includes two tabs (or "first stop elements") 94, 96 which protrude toward the first handle 36 from the flange 58 of the second bushing 56. The lower tab 94 can be seen in the cross sectional view of FIG. 5. Both tabs 94, 96 can be seen, from a viewpoint looking outward from the flange 58, in FIG. 9. They protrude into a recess 98 in the inner side of the first handle 36 and overlap a cross member (or "second stop element") 104 in the recess 98.

The tabs 94, 96 are positioned on the flange 58 so that the cross member 104 meets the lower tab 94 approximately when the first flush lever arm 30 meets the lower blocking member 72 and so that the cross member 104 meets the upper tab 96 approximately when the first flush lever arm 30 meets the upper blocking member 70. The time of contact need not be simultaneous but should be such that the tabs 94, 96 and the blocking member 70, 72 share the force generated by the user's rotation of the first handle 36. This allows each of the blocking members 70, 72 to be smaller and lighter (or in the alternative gives greater strength to the system).

The parts of the illustrated embodiment, other than second shaft 48, liner 90 and screw 92 (which have been made of a metal such as brass), have been made of plastic by injection molding. However, different materials and methods of manufacture could also be used.

In addition to the specific embodiment shown, the invention may appear in other embodiments. For example, the shafts 38 and 48 may be integral with, or separate parts from the handles 36 and 46 respectively. The second flush lever arm 32 may be held to the second shaft 40 by a cotter key, snap ring or other means. The flush lever arms 30, 32 may have different shapes to better fit particular tank types. Thus, there may be various modifications and changes in the embodiments which have been shown which are within the scope of the invention. Such modifications and changes are meant to be within the scope of the invention.

I claim:

1. A toilet tank trip lever assembly mountable through a hole in a wall of a toilet tank and being of the type that has two lever arms positionable in the tank to effectuate a higher volume flush or a lower volume flush as selected by the user, the assembly comprising:

a hollow first shaft extendable through and being rotatably supportable in the mounting hole, a first handle being mounted on the first shaft outside of the tank to rotate the first shaft;

a second shaft disposed in the first shaft hollow to rotate within the first shaft, and supporting outside of the tank a second handle that rotates the second shaft;

a first and a second flush lever arm positionable within the tank connected to the first shaft and the second shaft, respectively, such that rotation of the first handle rotates the first flush lever arm and rotation of the second handle rotates the second flush lever arm;

a blocking member extending transverse to both the first and second flush lever arms and adapted to be secured with respect to the tank so that the blocking member imposes a limit on the upward movement of both the first and the second flush lever arms;

a first stop element fixedly supportable on the tank wall; and a second stop element on at least one of the first and second handles;

wherein the stop elements interfere with each other when, upon rotation of said one of the handles, the flush lever arm associated with said one of the handles contacts the blocking member, whereby the interference between the stop elements supplements the action of the blocking member in limiting the range of rotation of the flush lever arm associated with said one of the handles when a lever arm is moving upward; wherein rotation of the first handle does not rotate the second handle and rotation of the second handle does not rotate the first handle.

2. The trip lever assembly as recited in claim 1, wherein the first stop element extends from a bushing which is adapted to rotatably support the first shaft in the mounting hole.

3. In a toilet tank trip assembly, mountable through a hole in wall of a toilet tank, of the type which allows a user to select between different flush volumes by operating either of two handles each of which rotates a shaft to rotate a respective flush lever arm, the handles rotating about a common axis, and further includes a single blocking member adapted to be secured with respect to the tank for imposing a limit on the upward movement of both flush lever arms, the improvement comprising:

(a) a first stop element fixedly supportable on the tank wall; and (b) a second stop element on at least one of the handles;

(c) wherein the stop elements interfere with each other when, upon rotation of said one of the handles the flush lever arm associated with said one of the handles contacts the blocking member, whereby the interference between the stop element supplements the action of the blocking member in limiting the range of rotation of the flush lever arm associated with said one of the handles when a lever arm is moving upward; wherein rotation of one of said handles does not rotate the other of said handles and rotation of said other handle does not rotate said one handle.

* * * * *